US009091180B2

(12) United States Patent
Wiebe et al.

(10) Patent No.: US 9,091,180 B2
(45) Date of Patent: Jul. 28, 2015

(54) AIRFOIL ASSEMBLY INCLUDING VORTEX REDUCING AT AN AIRFOIL LEADING EDGE

(75) Inventors: David J. Wiebe, Orlando, FL (US); Bruce L. Smith, Oviedo, FL (US); Matthew D. Montgomery, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 775 days.

(21) Appl. No.: 13/552,708

(22) Filed: Jul. 19, 2012

(65) Prior Publication Data

US 2014/0023483 A1 Jan. 23, 2014

(51) Int. Cl.

| | |
|---|---|
| ***F01D 25/00*** | (2006.01) |
| ***F01D 9/06*** | (2006.01) |
| ***F01D 5/18*** | (2006.01) |
| ***F01D 5/14*** | (2006.01) |

(52) U.S. Cl.

CPC ..... *F01D 25/00* (2013.01); *F01D 5/145* (2013.01); *F01D 5/18* (2013.01); *F01D 9/06* (2013.01); *F05D 2240/80* (2013.01); *Y10T 29/49234* (2015.01)

(58) Field of Classification Search

CPC ..... F01D 5/145; F01D 9/06; F01D 5/18; F01D 2240/127; F01D 2240/80; F01D 2240/81; Y10T 29/49234

See application file for complete search history.

(56) References Cited

U.S. PATENT DOCUMENTS

| | | | | |
|---|---|---|---|---|
| 4,946,346 | A | 8/1990 | Ito | |
| 5,340,278 | A | 8/1994 | Magowan | |
| 5,382,135 | A | 1/1995 | Green | |
| 6,341,939 | B1 | 1/2002 | Lee | |
| 6,616,405 | B2 | 9/2003 | Torii et al. | |
| 6,719,529 | B2 | 4/2004 | Tiemann | |
| 6,830,432 | B1 | 12/2004 | Scott et al. | |
| 7,001,141 | B2 | 2/2006 | Cervenka | |
| 7,097,417 | B2 | 8/2006 | Liang | |
| 7,217,096 | B2 | 5/2007 | Lee | |
| 7,220,103 | B2 | 5/2007 | Cunha et al. | |
| 7,249,933 | B2 | 7/2007 | Lee et al. | |
| 7,309,212 | B2 * | 12/2007 | Itzel et al. | 416/193 A |
| 7,597,536 | B1 | 10/2009 | Liang | |
| 7,621,718 | B1 | 11/2009 | Liang | |
| 7,637,716 | B2 | 12/2009 | Benton | |
| 7,695,247 | B1 | 4/2010 | Liang | |
| 7,766,618 | B1 * | 8/2010 | Liang | 416/97 R |
| 7,857,580 | B1 * | 12/2010 | Liang | 415/115 |
| 8,221,055 | B1 * | 7/2012 | Liang | 415/115 |
| 8,282,341 | B2 * | 10/2012 | Freeman et al. | 415/115 |
| 8,435,001 | B2 * | 5/2013 | Montgomery et al. | 415/210.1 |
| 8,529,194 | B2 * | 9/2013 | Ammann et al. | 415/115 |

(Continued)

*Primary Examiner* — Edward Look
*Assistant Examiner* — Christopher R Legendre

(57) ABSTRACT

An airfoil assembly including an endwall and an airfoil extending from the into a gas flow path. The endwall includes upstream and downstream edges, and is defined on a platform structure having a front surface extending radially in a direction of a thickness of the platform structure. At least one fluid injection passage extends through the platform structure in a direction from the upstream edge toward the downstream edge of the endwall. The fluid injection passage has an outlet opening defined at the endwall and an inlet opening in fluid communication with a pressurized fluid source. The fluid injection passage extends at a shallow angle relative to a plane of the endwall wherein the fluid injection passage defines a passage axis passing through the front surface and the endwall for effecting energization of a boundary layer between the outlet opening and the airfoil leading edge.

17 Claims, 5 Drawing Sheets

(56) References Cited

U.S. PATENT DOCUMENTS 8,591,176 B2 * 11/2013 Guemmer ..... 415/116
8,628,293 B2 * 1/2014 Ramachandran et al. .... 415/115
2006/0127220 A1 6/2006 Lee
2009/0202339 A1 * 8/2009 Torii et al. ..... 415/115
2014/0023483 A1 * 1/2014 Wiebe et al. ..... 415/115
2014/0154063 A1 * 6/2014 Zhang et al. ..... 415/177

* cited by examiner

AIRFOIL ASSEMBLY INCLUDING VORTEX REDUCING AT AN AIRFOIL LEADING EDGE

FIELD OF THE INVENTION

The present invention relates generally to turbine engines and, more particularly, to a structure provided to a turbine airfoil endwall for reducing vortices.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades form a stage in the turbine section.

Advanced gas turbines with high performance requirements attempt to reduce the aerodynamic losses as much as possible in the turbine section. This in turn results in an improvement of the overall thermal efficiency and power output of the engine. As illustrated in FIG. 8, one source of aerodynamic losses is the formation of a variety of vortex flows 2 that may occur as a result of the boundary layer that is formed between a hot working gas flow and an endwall 3 located at the end of an airfoil 4 tending to adhere to the endwall 3, with a resulting lower velocity than the main body of the gas flow. For, example, vortex flows known as horseshoe vortices may form at upstream leading edge locations 5 where the airfoils 4 attach to the endwall 3 and may extend a substantial distance downstream between adjacent airfoils.

SUMMARY OF THE INVENTION

In accordance with an aspect of the invention, an airfoil assembly is provided for an axial flow gas turbine engine, the gas turbine engine including an axially directed flow path defining a passage for a working fluid and a source of pressurized fluid. The airfoil assembly includes an endwall having an upstream edge and a downstream edge axially spaced from the upstream edge. An airfoil extends from the endwall into the flow path, the airfoil having a leading edge and a trailing edge, and a pressure side and a suction side extending between the leading and trailing edges. The endwall is defined on a platform structure having a front surface adjacent to the upstream edge, the front surface extending radially in a direction of a thickness of the platform structure. At least one fluid injection passage extends through the platform structure in a direction from the upstream edge toward the downstream edge. The fluid injection passage has an outlet opening defined at the endwall and an inlet opening in fluid communication with a pressurized fluid source.

The fluid injection passage extends at a shallow angle relative to a plane of the endwall wherein the fluid injection passage defines a passage axis passing through the front surface and the endwall.

In accordance with further aspects, the fluid injection passage may extend along an axis oriented at an angle relative to the plane of the endwall that is in a range from about 10 to 20 degrees. More particularly, the fluid injection passage may extend along an axis oriented at an angle of less than about 15 degrees.

The outlet opening of the fluid injection passage may be located axially between the upstream edge of the endwall and the leading edge of the airfoil. The axis of the fluid injection passage may be oriented to direct a fluid flow from the outlet opening generally parallel to a local streamline of the working fluid, and generally directed toward the leading edge of the airfoil.

The inlet opening of the fluid injection passage may be in fluid communication with a fluid supply passage providing fluid from the pressurized fluid source, and the axis of the fluid injection passage may extend in a direction that is transverse to an axis of the fluid supply passage. The fluid injection passage may be formed by a bore extending from an access opening at the front surface of the platform structure to the outlet opening of the at least one fluid injection passage, and a portion of the access opening may be closed with a plug. The fluid supply passage may extend in a circumferential direction through the platform structure, generally parallel to the upstream edge, and supply fluid to a plurality of the fluid injection passages.

The platform structure may include a platform member formed integrally with the airfoil, and a platform cover may be located on a radially outwardly facing surface of the platform member, and the fluid injection passage may be formed in the platform cover. A fluid supply cavity may be defined between the platform member and the platform cover, the fluid injection passage being in fluid communication with the fluid supply cavity, and a fluid supply passage may extend generally parallel to the radially outwardly facing surface of the platform member and supply fluid from the pressurized fluid source to the fluid supply cavity.

The outlet opening may be defined within the platform structure, radially inwardly from the endwall, and may include an elongated pocket extending from the outlet opening in an axial direction toward the leading edge of the airfoil. The elongated pocket may include a bottom wall extending from the outlet opening toward the endwall at an angle generally parallel to an axis of the fluid injection passage. The pocket may include first and second side walls located on opposing sides of the bottom wall, and the first and second side walls may extend parallel to each other from the outlet opening toward the endwall.

The platform structure may include a radially inwardly facing surface opposite the endwall and adjacent to the front surface, and the axis of the fluid injection passage may pass through the front surface radially between the endwall and the inwardly facing surface.

In accordance with another aspect of the invention, a method of providing a fluid injection passage in an airfoil assembly for an axial flow gas turbine engine is described. The airfoil assembly includes a platform structure and an airfoil extending radially from the platform structure and having a leading edge and a trailing edge. The platform structure defines an endwall having an upstream edge and a downstream edge and has a radially extending front surface adjacent to the upstream edge. The method comprises forming a fluid injection bore in at least a portion of the platform structure defining a fluid injection passage extending from an inlet opening for the fluid injection passage to an outlet opening at the endwall, and extending at a shallow angle relative to the endwall; forming a fluid supply bore extending transverse to the fluid injection bore for supplying fluid to the fluid injection passage, the fluid supply bore having at least a portion extending to an exterior surface of the platform structure; and placing a plug in a portion of at least one of the fluid injection bore and the fluid supply bore for preventing passage of fluid out of the platform structure at the location of the plug.

The fluid supply bore may be formed starting at a radially inner side of the platform structure and intersecting the fluid injection bore at the inlet opening of the fluid injection passage opposite from the outlet opening. The step of placing a plug may comprise inserting the plug through the front surface of the platform structure at a location of the fluid injection bore adjacent to its intersection with the fluid supply bore.

The step of forming a fluid injection bore may comprise forming two diameters including a larger diameter defining an access opening extending through the front surface of the platform structure and a small diameter defining the fluid injection passage.

The fluid injection bore may be formed starting from the front surface of the platform structure adjacent to the endwall and extending to the outlet opening passing through the endwall.

The platform structure may comprise a platform member formed integrally with the airfoil and a platform cover for positioning over the platform member, and the fluid injection passage may be formed in the platform cover. The step of forming a fluid injection bore in at least a portion of the platform structure may comprise, in sequence, the steps of: forming the fluid injection bore in the platform cover extending from a radially inner side of the platform cover to a radially outer side of the platform cover at a shallow angle of less than about 20 degrees relative to an outer side of the platform cover; and positioning the platform cover over the platform member with the inner side of the platform cover in engagement with a radially outwardly facing surface of the platform member.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
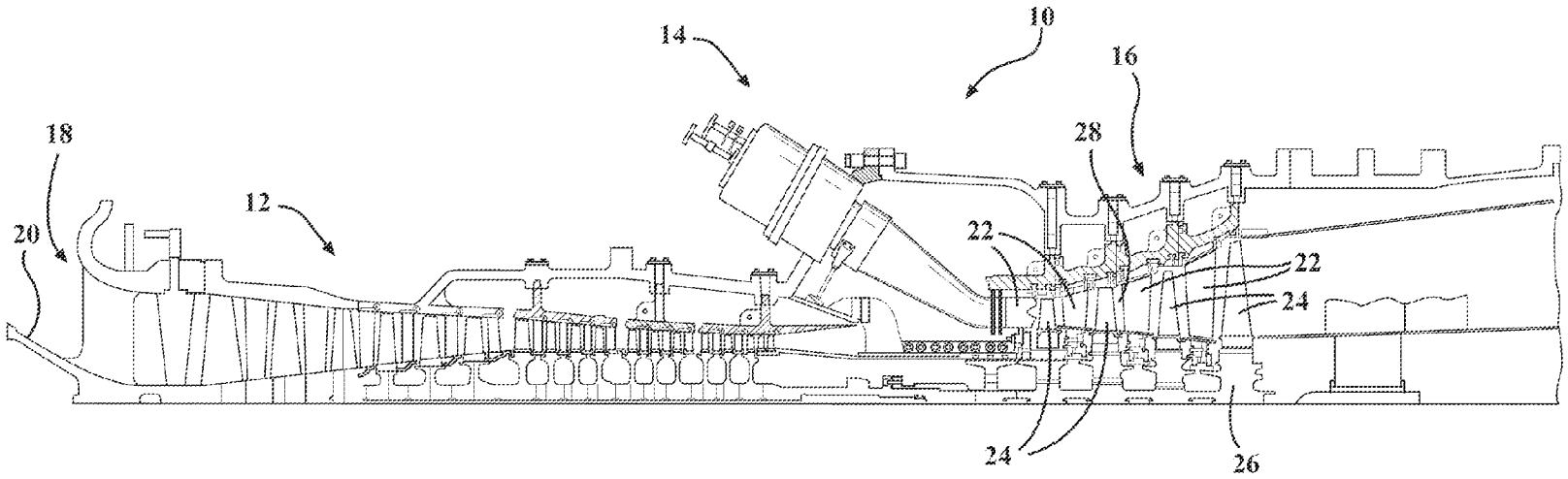
FIG. 1 is a partial cross-sectional view of a gas turbine engine incorporating an airfoil assembly formed in accordance with aspects of the present invention.

Referring to FIG. 1, a gas turbine engine 10 is illustrated including a compressor section 12, a combustor 14, and a turbine section 16. The compressor section 12 compresses ambient air 18 that enters an inlet 20. The combustor 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flowpath 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown). In addition to providing air to the combustor 14, bleed air from the compressor 12 may be provided to components of the turbine section 16, such as for providing a cooling fluid to the turbine components.

Figure 2:
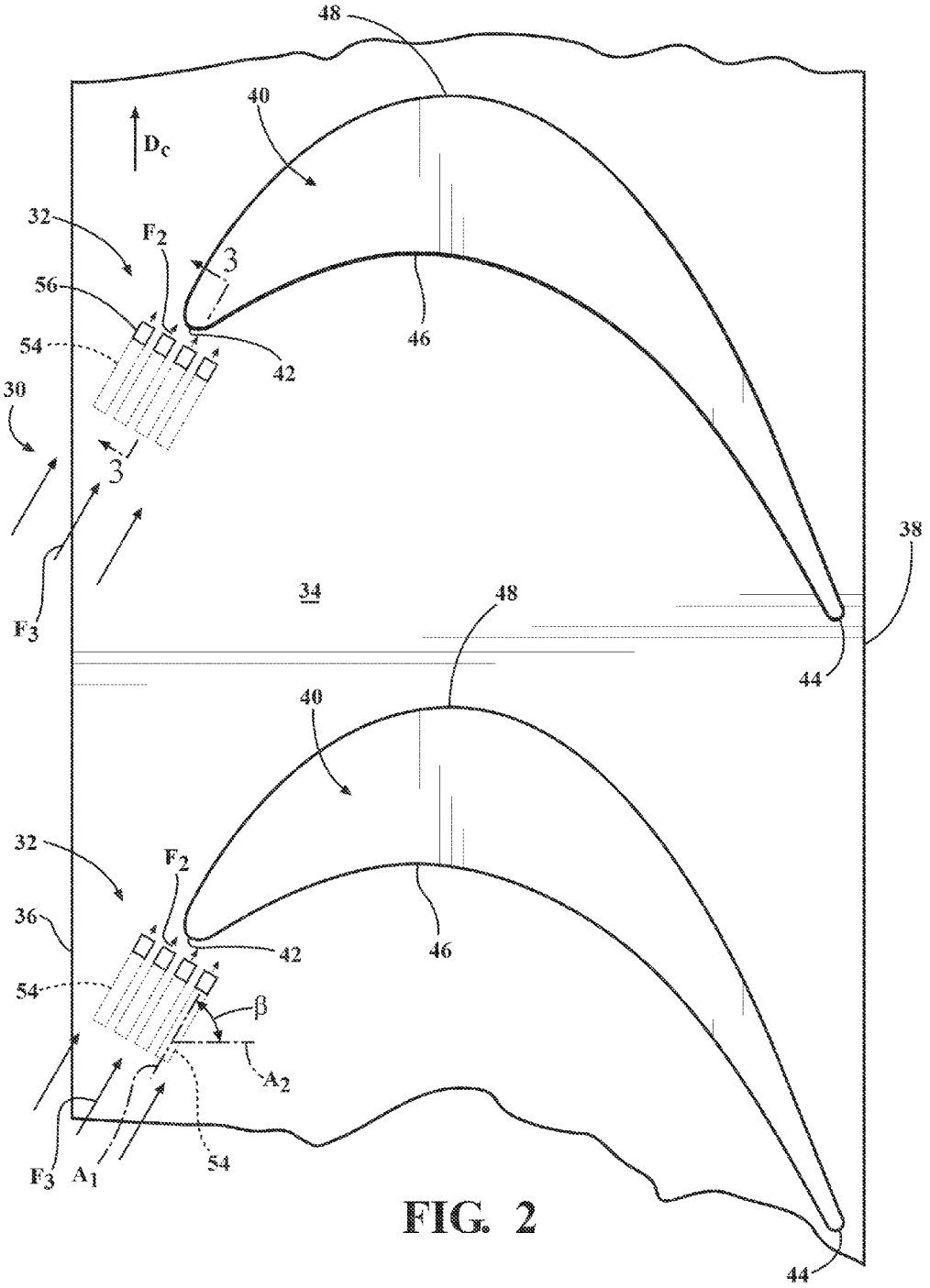
FIG. 2 is a plan view of a portion of an airfoil array of a turbine stage illustrating aspects of the present invention.

Referring to FIG. 2, an airfoil structure 30, such as may be formed by one or more vane assemblies 32 in the turbine section 16, is illustrated and comprises one or more of the vanes of the row of vanes 22 shown herein for the purpose of describing aspects of the present invention. However, it should be understood that the following description is not limited to implementation on an airfoil structure comprising vanes, and the described aspects of the invention may be implemented on other airfoil structures, such as may be implemented on one or more blades of the row of blades 24.

Further, it should be understood that the terms "inner", "outer", "radial", "axial", and the like, as used herein, are not intended to be limiting with regard to an orientation or particular use of the elements recited for aspects of the present invention.

As illustrated in FIG. 2, the vane assembly 32 comprises an endwall 34 having an upstream edge 36, and a downstream edge 38 axially spaced from the upstream edge 36. An airfoil 40 extends from the endwall 34 into the flowpath 28. The airfoil 40 includes a leading edge 42 located adjacent to the upstream edge 36 of the endwall 34 and a trailing edge 44 adjacent to the downstream edge 38 of the endwall 34. A radially extending pressure wall defining a pressure side 46 of the airfoil 40, and a radially extending suction wall defining a suction side 48 of the airfoil 40 each extend between the leading edge 42 and the trailing edge 44. In addition, it may be understood that a cavity 41 (see FIG. 7) may extend radially through the airfoil 40 between the pressure and suction sides 46, 48, such as may be provided for conveying a cooling fluid through the airfoil 40.

Figure 3:
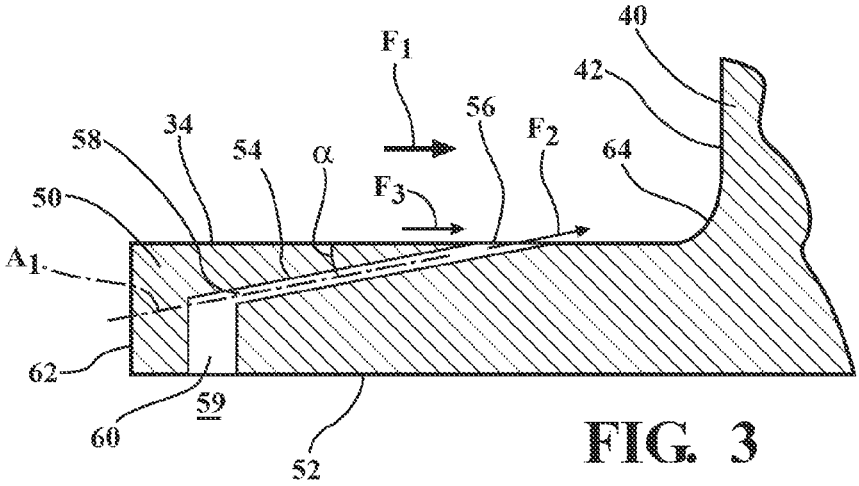
FIG. 3 is a cross-sectional view taken along line 3-3 in FIG. 2.

Referring additionally to FIG. 3, the endwall 34 is defined on a platform structure comprising a platform 50 that may be formed integrally with the airfoil 40. The platform 50 has a thickness extending in the radial direction, such as may be defined between opposing outer sides comprising the endwall 34 and an inner surface 52 of the platform structure 50. As noted above, a hot working gas flowing through the gas path 28 tends to adhere to the endwall 34 with a resulting formation of vortices. In particular horseshoe vortices may form adjacent to the junction between the airfoil 40 and the endwall 34, beginning at the leading edge 42 of the airfoil 40. In accordance with an aspect of the invention, at least one fluid injection passage 54 through the platform 50, and preferably a plurality of fluid injection passages 54 extend through the platform 50 at a location between the upstream edge 36 of the endwall 34 and the leading edge 42 of the airfoil 40.

The fluid passages 54 extend through the platform 50 in the axial direction, defined as extending from the upstream edge 36 toward the downstream edge 38. Each fluid passage 54 is preferably a straight passage that has an outlet opening 56 defined at the endwall 34 and an inlet opening 58 in fluid communication with a pressurized fluid source, generally indicated at 59. For example, the pressurized fluid source 59 may comprise the compressor section 12 or a flow passage in fluid communication with the compressor 12, such as may be provided for supplying bleed air to cooling passages in and/or around components of the turbine section 16. In accordance with aspects of the invention illustrated in FIG. 3, a radial passage 60 transverse to the fluid passage 54 extends from the inner surface 52 of the platform 50 to the inlet opening 58 for the fluid passage 54. The radial passage 60 extends generally parallel to, and may be located close to, a front surface 62, i.e., an axially forward facing surface, of the platform 50. A pressurized fluid, such as air bled from the compressor 12, may pass through the radial passage 60 to the fluid passage inlet 58 adjacent a radially outer end of the radial passage 60. The air provided to the radial passage 60 may comprise, for example, cooling air provided to radially radially inner rotor cavities and/or cooling air that passes through the airfoil 40 for cooling the airfoil 40 and that is channeled toward the location of the radial passage 60.

As may be seen in FIG. 3, the fluid passage 54 extends at a shallow angle relative to a plane of the endwall 34, i.e., a plane generally parallel the outwardly facing surface of the endwall 34. In accordance with an aspect of the invention, a longitudinal axis $A_1$ of the fluid passage 54 intersects a radially extending portion of the axially forward face of the platform 50 defined by the front surface 62. In general, the shallow angle of the fluid passage 54 may comprise an angle $\alpha$ measured between the endwall 34 and the longitudinal axis $A_1$ within a range from about 10 degrees to about 20 degrees. More preferably, the angle $\alpha$ of the fluid passage 54 comprises a very shallow angle where the angle $\alpha$ of the axis $A_1$ relative to the endwall 34 is less than about 15 degrees.

The configuration of the fluid passage 54 and the angle $\alpha$ of the fluid passage 54 relative to the endwall 34 preferably provides a high velocity fluid flow or injection flow $F_2$ from the outlet opening 56 at a shallow angle directing a substantial portion of the high velocity injection flow into a boundary layer between the main working gas flow $F_1$ and the endwall 34, and oriented to direct the high velocity flow toward the leading edge 42 of the airfoil 40. Further, an angle $\beta$ of the flow passage 54 relative to a line $A_2$ parallel to the central axis of the turbine engine 10, as seen in the plan view of FIG. 2, is determined by the local flow of the main working gas flow $F_1$. That is, the orientation of each fluid passage 54 is determined by local streamlines $F_3$, as determined by a local flow over the endwall 34, in order to direct the injection flow $F_2$ from the outlet opening 56 in a direction generally parallel to the local streamlines $F_3$ at the location where the fluid exits the outlet opening 56. The position of the outlet opening 56 in the circumferential direction $D_C$ is determined by the direction of the local streamlines $F_3$ in order position the outlet opening 56 to direct the high velocity injection flow $F_2$ into a portion of the boundary layer for the main working gas flow $F_1$ that is directed toward the leading edge 42.

The outlet opening 56 is located substantially close to the leading edge 42 to limit or reduce the formation of vortices that normally form at the junction between the airfoil 40 and the endwall 34, such as a junction that may be defined by a fillet 64 extending between the airfoil 40 and the endwall 34. That is, the outlet opening 56 is preferably located sufficiently close to the airfoil leading edge 42 such that injection flow $F_2$ from the fluid passage 54 increases the momentum or energy of the boundary layer flow at the junction 64. The shallow angle $\alpha$ of the injection flow $F_2$ from the outlet opening 56 of each fluid passage 54 facilitates maintaining the injection flow $F_2$ close to the surface of the endwall 34 as it exits the opening 56 in order to energize the boundary layer along the endwall 34 directly adjacent to the leading edge 42 with an injection flow $F_2$ that is flowing in the direction of the local streamlines $F_3$. Hence, in accordance with an aspect of the invention, the velocity of the injection flow $F_2$ exiting the outlet opening 56 is maintained as much as possible in order to energize the boundary layer for reduction or limitation of vortex formation at the leading edge 42, and the high velocity injection flow $F_2$ is further maintained close to the endwall 34, i.e., within the boundary layer, by providing a shallow exit angle $\alpha$.

It should be noted that, as seen in FIG. 3, the radial passage 60 is formed with a substantially greater diameter than the diameter of the fluid passage 54 in order to avoid or limit any supply pressure losses and maintain a high fluid supply pressure at the inlet opening 58. Further, the radial passage 60 may comprise a passage or a slot that is elongated in the circumferential direction $D_C$, e.g., extending generally parallel to the upstream edge 36, and that may supply a plurality of the fluid passages 54.

Figure 4:
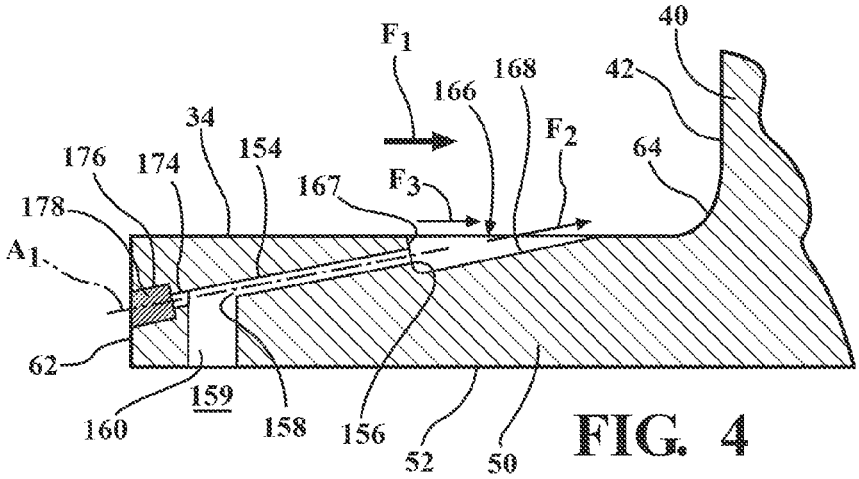
FIG. 4 is a cross-sectional view similar to FIG. 3 illustrating further aspects of the invention.

Referring to FIG. 4, a variation on the fluid passage 54 described with reference to FIGS. 2 and 3 is shown, identified as fluid injection passage 154, including an aspect for formation of the fluid passage 154 at a shallow angle. The fluid passage 154 includes an outlet opening 156 and an inlet opening 158 in fluid communication with a pressurized fluid source, generally indicated at 159. The fluid source 159 may comprise a radial passage 160 for conveying a pressurized fluid to the inlet opening 158 of the fluid passage 154 in a manner similar to that described with reference to FIG. 3 above.

The outlet opening 156 is defined within the platform structure 50, and is located at or adjacent to the endwall 34, at a location that is radially inwardly from the outwardly facing surface of the endwall 34. An elongated pocket 166 extends from the outlet opening 156 in the axial direction generally toward the leading edge 42 of the associated airfoil 40. The elongated pocket 166 includes a bottom wall 168 extending from the outlet opening 56 toward the endwall 34 at an angle that is generally parallel to the axis $A_1$ of the fluid passage 154, and the outlet opening 156 is defined passing through a wall 167 extending radially between the endwall 34 and the bottom wall 168 at an upstream end of the pocket 166.

Figure 4A:
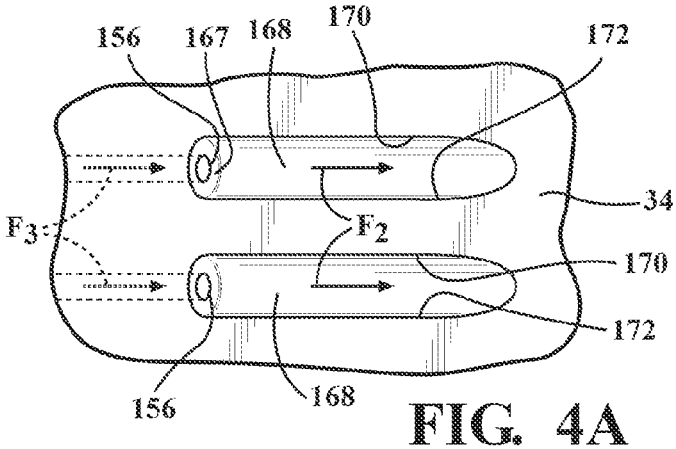
FIG. 4A is a plan view of a portion of an endwall illustrating two fluid flow exit passages in accordance with aspects shown in FIG. 4.

Referring to FIG. 4A, it may be seen that the outlet opening 156 is formed with first and second side walls 170, 172 located on opposing sides of the bottom wall 168. The first and second side walls 170, 172 extend generally parallel to each other from the outlet opening 156 to the endwall 34. In accordance with this aspect, the first and second side walls 170, 172 may comprise wall surfaces that are parallel to each other. Further, the spacing between the side walls 170, 172 may be limited to a distance less than twice the diameter of the fluid passage 154, and is preferably configured to keep the injection flow $F_2$ from spreading laterally and diffusing as it interacts with the boundary layer. The outlet opening 156 discharges the injection flow $F_2$ into the pocket 166 at a shallow angle, and the parallel pocket side walls 170, 172 facilitate maintaining the high velocity of the injection flow $F_2$ as it enters the boundary layer associated with the local stream lines $F_3$.

FIG. 4 further illustrates a method for providing the fluid passage 154 at a shallow angle in accordance with aspects of the present invention. The fluid passage 154 may be produced by forming a fluid injection bore 174 extending into the front surface 62 of the platform 50, aligned along the axis $A_1$, and passing through the location of the radial passage 160 to the outlet opening 156. The portion of the fluid injection bore 174 extending between the radial passage 160 and the outlet opening 156 defines the fluid passage 154. An outer end of the fluid injection bore 174 comprises an access opening and may be formed with an enlarged diameter portion 176, and a plug 178 is inserted into the enlarged diameter portion 176 to prevent the pressurized fluid from exiting the platform 50 from the access opening closed by the plug 178. Forming the fluid injection bore 174 through the front surface 62 enables the formation of the fluid passage 154 at a very shallow angle by initiating the drilling, or other bore forming operation, at a location on the front surface 62 that is close to the endwall 34. It may be understood the enlarged diameter portion 176 may be formed either before or after formation of the fluid injection bore 174 defining the smaller diameter fluid passage 154.

It may be understood that the method of forming the fluid passage 154 described with reference to FIG. 4, as well as other fluid passages described herein, advantageously overcomes limitations on orienting the fluid passage 154 at a very shallow angle. Hence, aspects of the present invention address limitations that may be imposed or associated with the construction of the platform 50, and its relationship relative to the airfoil 40, and that may otherwise limit formation of fluid passages oriented at a shallow angle.

Figure 5:
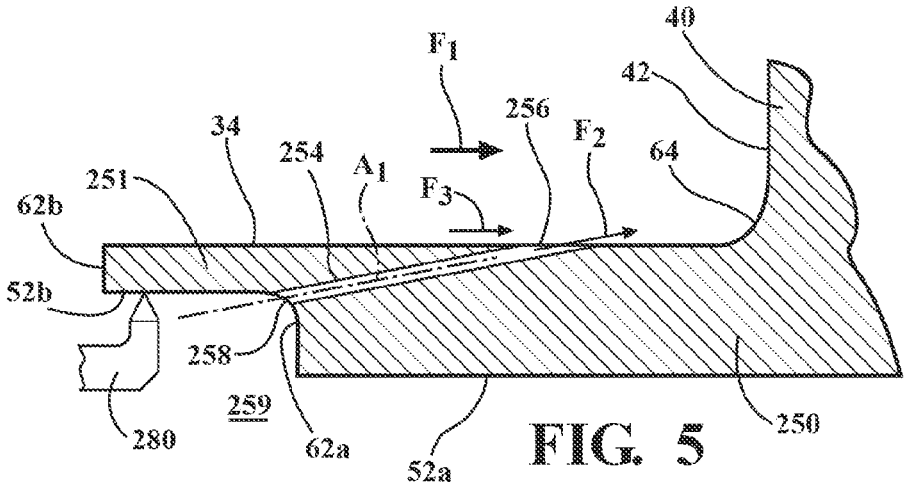
FIG. 5 is a cross-sectional view similar to FIG. 3 illustrating further aspects of the invention.

Referring to FIG. 5, an additional variation illustrating a fluid passage 254 is shown. FIG. 5 illustrates the fluid passage 254 formed in a platform 250 including an including an aspect for formation of the fluid passage 254 at a shallow angle relative to the endwall 34. The fluid passage 254 includes an outlet opening 256, and an inlet opening 258 in fluid communication with a pressurized fluid source, generally indicated at 259. The pressurized fluid source 259 may comprise, at least in part, a radially inner cooling air cavity defined radially inwardly from an inwardly located inner side portion 52*a* of the platform 250.

The inlet opening 258 is defined adjacent to a seal structure formed between an outwardly located inner side portion 52*b* of the platform 250 and a rotating seal 280 that may be associated with a rotating blade structure. In particular, the platform 250 may including an overhang portion 251 defining the inner side portion 52*b* for cooperating with the rotating seal 280 to separate the pressurized fluid source 259 from the hot working gas flowing through the flowpath 28 (FIG. 1). The front surface of the platform 250 includes a radially inner portion 62*a*, and a radially outer portion 62*b* formed on the overhang portion 251. The inlet opening 258 is formed extending axially through the front surface inner portion 62*a*, closely adjacent to a junction between the inner portion 62*a* and inner side portion 52*b* defined on the overhang portion 251. Hence, the fluid passage 254 may be supplied by pressurize fluid, such as cooling air, directly from a cavity forming the pressurized fluid source 259 to provide a high velocity flow of injection fluid $F_2$ to energize the boundary layer at local streamlines $F_3$ flowing across the endwall 34.

Figure 6:
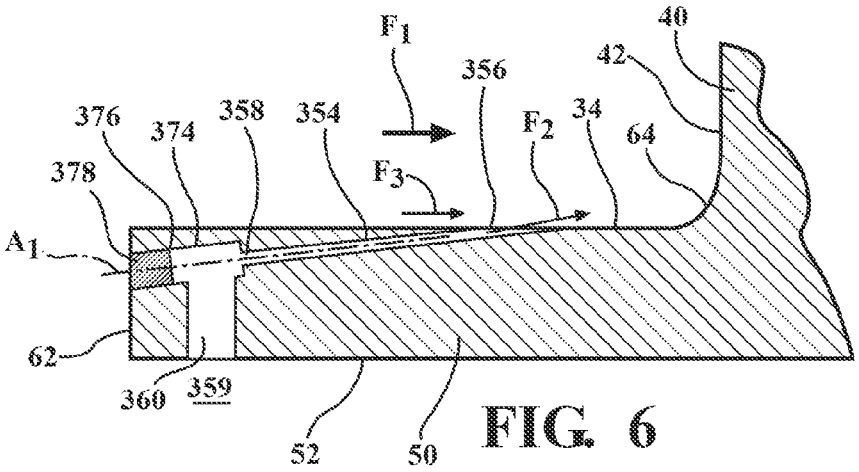
FIG. 6 is a cross-sectional view similar to FIG. 3 illustrating further aspects of the invention.

Referring to FIG. 6, an additional variation illustrating a fluid passage 354 is shown. FIG. 6 illustrates the fluid passage 354 formed in a platform 50 including an aspect for formation of the fluid passage 354 at a shallow angle relative to the endwall 34. The fluid passage 354 includes an outlet opening 356 and an inlet opening 358 in fluid communication with a pressurized fluid source, generally indicated at 359. The fluid source 359 may comprise a radial passage 360 for conveying a pressurized fluid to the inlet opening 358 of the fluid passage 354 in a manner similar to that described with reference to FIG. 3 above.

As described above for the fluid passage 154 with reference to FIG. 4, the fluid passage 354 may be produced by forming a fluid injection bore 374 extending into the front surface 62 of the platform 50, aligned along the axis $A_1$, and passing through the location of the radial passage 360 to the outlet opening 356. A portion of the fluid injection bore 374 extending between the radial passage 360 and the outlet opening 356 defines the fluid passage 354. An outer end of the fluid injection bore 374 comprises an access opening and may be formed with an enlarged diameter portion 376, and a plug 378 is inserted into the enlarged diameter portion 376 to prevent the pressurized fluid from exiting the platform 50 from the access opening closed by the plug 378. It may be noted that the enlarged portion 376 may extend from the front surface 62 to a location past the radial passage 360, such that the enlarged portion 376 provides an additional reservoir volume of pressurized fluid directly adjacent to the inlet opening 358 to maintain a high pressure for the pressurized fluid supplied to the fluid passage 354.

Figure 7:
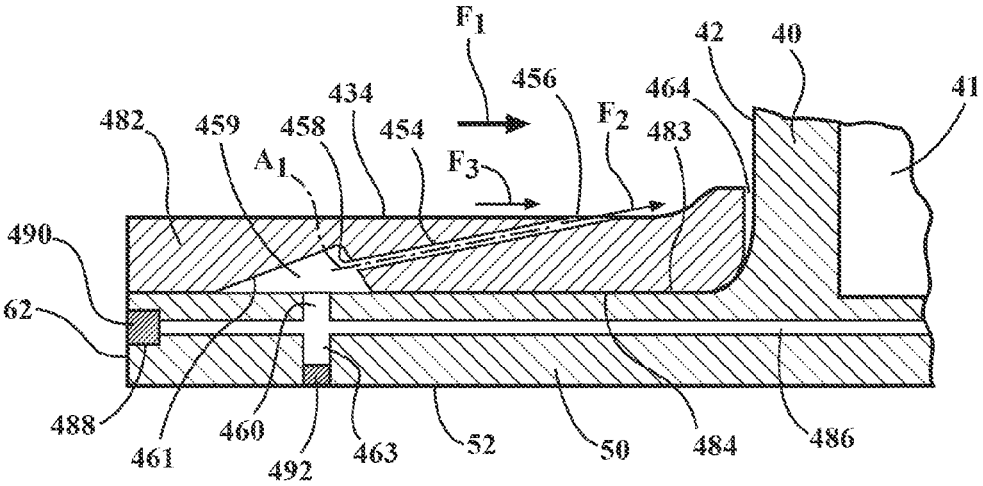
FIG. 7 is a cross-sectional view similar to FIG. 3 illustrating further aspects of the invention, including a platform cover incorporating aspects of the invention.
Figure 8:
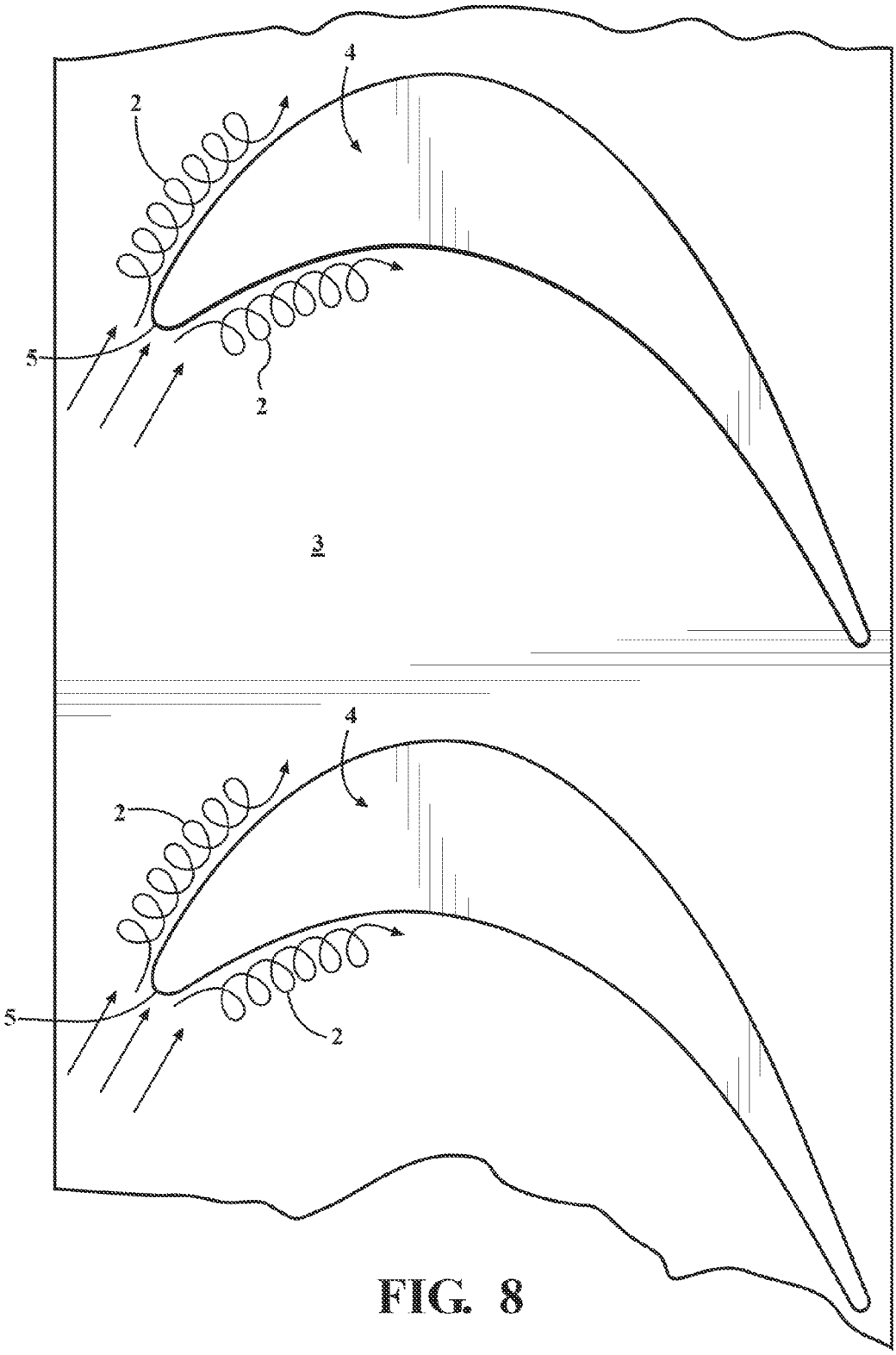
FIG. 8 is a plan view of a portion of an airfoil array of a turbine stage, diagrammatically illustrating a typical vortex flow around leading edges of airfoils.

FIG. 7 illustrates a further aspect of the invention including a platform structure comprising a platform cover 482 affixed on the platform 50 and defining the endwall 434, generally corresponding to the endwall 34 discussed above with regard to FIG. 3, and extending at least to a junction 464 with the airfoil leading edge 42. The platform cover 482 includes a fluid passage 454 formed at a shallow angle relative to the endwall 434. The fluid passage 454 includes an outlet opening 456 and an inlet opening 458 in fluid communication with a pressurized fluid source, a portion of which is generally indicated as a fluid source portion 459.

In accordance with an aspect of the invention, the platform cover 482 includes an inner cover surface 484 that is affixed in engagement with a radially outwardly facing outer surface 483 of the platform 50. The fluid source portion 459 may comprise a machined or cast indentation formed in the inner cover surface 484 which, when placed in association with the outer surface 483 of the platform 50, forms a chamber 461 defining at least a portion of the pressurized fluid source 459 for supplying the pressurized fluid to the fluid passage 454. The chamber 461 may be formed with any shape that is convenient to manufacture and that further provides a reservoir of pressurized fluid for supplying the injection flow $F_2$ from the outlet opening 456.

In accordance with another aspect depicted in FIG. 7, the fluid source may comprise the cavity 41 extending through the vane 40, and includes an axial passage 486 extending generally parallel to the platform surface 483 from a location in fluid communication with pressurized fluid, such as pressurized cooling air, from the cavity 41, and extending to the front surface 62 of the platform 450. An end of the axial passage 486 comprises an access opening and may be defined by an enlarged portion 488 receiving a plug 490. A connection between the axial passage 486 and the chamber 461 may be formed by a bore 463 forming a radial passage 460 from the inner side 52 of the platform 50 through the outer surface 483. The bore 463 may comprise an enlarged passage relative to the axial passage 486, and the opening at the inner side 52 of the platform 50 comprises an access opening that may be closed by a plug 492, thereby forming a fluid path supplying pressurized fluid from the vane cavity 41 to the pressurized fluid source 459 for the fluid passage 454.

The construction illustrated in FIG. 7 facilitates formation of the fluid passage 454 at a very shallow angle in that the fluid passage 454 may be formed in the platform cover 482 under controlled manufacturing conditions permitting selection of a preferred fluid passage angle prior to attachment of the platform cover 482 to the platform 50. Further, the pressurized fluid source 459, as defined by the chamber 461 may be shaped to a desired configuration to facilitate supply of pressurized fluid to the fluid passage 454 without reduction of the fluid pressure received from the axial passage 486.

It should understood that one or more of any of the aspects described with reference to FIGS. 2-7 may be incorporated in combination with one or more of any other of the aspects described herein, or may be used separately from any other aspect to accomplish the effects described for the present invention. Further, it may be understood that any number of the above-described fluid passages may be provided to accomplish the particular effects described for the present invention. It may be seen from the above-described aspects of the invention, that the present invention provides a preferably non-diffused injection of fluid, such as air, into the gas flow approaching the joint area between the airfoil leading edge and the endwall surface. Further a vortex flow may be substantially reduced or limited by providing the injection of fluid at a high velocity, while injecting the fluid at a very shallow angle to substantially maintain the injected flow closely adjacent to the endwall surface in a boundary layer between a main gas flow and the endwall surface.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil assembly for an axial flow gas turbine engine, the gas turbine engine including an axially directed flow path defining a passage for a working fluid and a source of pressurized fluid, the airfoil assembly including:

an endwall having an upstream edge and a downstream edge axially spaced from the upstream edge;

an airfoil extending from the endwall into the flow path, the airfoil having a leading edge and a trailing edge, and a pressure side and a suction side extending between the leading and trailing edges;

the endwall is defined on a platform structure having a front surface adjacent to the upstream edge, the front surface extending parallel to a radial direction, along a direction of a thickness of the platform structure;

at least one fluid injection passage extending through the platform structure in a direction from the upstream edge toward the downstream edge, and each fluid injection passage having an outlet opening defined at the endwall and an inlet opening in fluid communication with a pressurized fluid source;

each fluid injection passage extending through the platform structure at a shallow angle relative to a plane of the endwall wherein the extension of each fluid injection passage through the platform structure defines a passage axis passing through the front surface and the endwall, wherein the respective outlet opening of each fluid injection passage is located axially between the upstream edge of the endwall and the leading edge of the airfoil, and wherein the respective passage axis along which each fluid injection passage extends through the platform structure is oriented at an angle relative to the plane of the endwall that is in a range from about 10 to 20 degrees.

2. The airfoil assembly of claim 1, wherein the respective passage axis along which each fluid injection passage extends is oriented at an angle of less than about 15 degrees.

3. The airfoil assembly of claim 1, wherein the respective inlet opening of each fluid injection passage is in fluid communication with a fluid supply passage providing fluid from the pressurized fluid source, the respective passage axis of each fluid injection passage extending in a direction that is transverse to an axis of the respective fluid supply passage.

4. The airfoil assembly of claim 3, wherein each fluid injection passage is formed by a bore extending from an access opening at the front surface of the platform structure to the respective outlet opening of each fluid injection passage, and a portion of each access opening is closed with a plug.

5. The airfoil assembly of claim 1, wherein the platform structure includes a platform member formed integrally with the airfoil, and a platform cover located on a radially outwardly facing surface of the platform member, and each fluid injection passage is formed in the platform cover.

6. The airfoil assembly of claim 5, including a fluid supply cavity defined between the platform member and the platform cover, each fluid injection passage being in fluid communication with the fluid supply cavity, and a fluid supply passage extending generally parallel to the radially outwardly facing surface of the platform member and supplying fluid from the pressurized fluid source to the fluid supply cavity.

7. The airfoil assembly of claim 1, wherein each outlet opening is defined within the platform structure, radially inwardly from the endwall, and including an elongated pocket extending from the respective outlet opening in an axial direction toward the leading edge of the airfoil, each elongated pocket including a bottom wall extending from the respective outlet opening toward the endwall at an angle generally parallel to the respective passage axis of each fluid injection passage.

8. The airfoil assembly of claim 7, wherein each pocket includes first and second side walls located on opposing sides of the respective bottom wall, the respective first and second side walls extending parallel to each other from the respective outlet opening toward the endwall.

9. The airfoil assembly of claim 1, wherein the platform structure includes a radially inwardly facing surface opposite the endwall and adjacent to the front surface, and the respective passage axis of each fluid injection passage passes through the front surface radially between the endwall and the inwardly facing surface.

10. The airfoil assembly of claim 1, wherein the respective passage axis of each fluid injection passage is oriented to direct a fluid flow from the respective outlet opening generally parallel to a local streamline of the working fluid, and generally directed toward the leading edge of the airfoil.

11. A method of providing a fluid injection passage in an airfoil assembly for an axial flow gas turbine engine, the airfoil assembly including a platform structure and an airfoil extending radially from the platform structure and having a leading edge and a trailing edge, the platform structure defining an endwall having an upstream edge and a downstream edge and having a front surface adjacent to the upstream edge, the front surface extending parallel to a radial direction along a thickness direction of the platform structure, the method comprising:

forming a fluid injection bore in at least a portion of the platform structure defining each fluid injection passage which extends from an inlet opening for the fluid injection passage to an outlet opening at the endwall, and extending at a shallow angle relative to the endwall;

forming a fluid supply bore extending transverse to the fluid injection bore for supplying fluid to the fluid injection passage, the fluid supply bore having at least a portion extending to an exterior surface of the platform structure; and placing a plug in a portion of at least one of the fluid injection bore and the fluid supply bore for preventing passage of fluid out of the platform structure at the location of the plug, wherein the fluid injection bore is formed such that the outlet opening of the fluid injection passage is located axially between the upstream edge of the endwall and the leading edge of the airfoil, and wherein a passage axis along which the fluid injection passage extends through the platform structure is oriented at an angle relative to the plane of the endwall that is in a range from about 10 to 20 degrees.

12. The method of claim 11, wherein the fluid supply bore is formed starting at a radially inner side of the platform structure and intersecting the fluid injection bore at the inlet opening of the fluid injection passage opposite from the outlet opening.

13. The method of claim 12, wherein the step of placing a plug comprises inserting the plug through the front surface of the platform structure at a location of the fluid injection bore adjacent to its intersection with the fluid supply bore.

14. The method of claim 11, wherein the step of forming a fluid injection bore comprises forming two diameters including a larger diameter defining an access opening extending through the front surface of the platform structure and a smaller diameter defining the fluid injection passage.

15. The method of claim 11, wherein the fluid injection bore is formed starting from the front surface of the platform structure adjacent to the endwall and extending to the outlet opening passing through the endwall.

16. The method of claim 11, wherein the platform structure comprises a platform member formed integrally with the airfoil and a platform cover for positioning over the platform member, and the fluid injection passage is formed in the platform cover.

17. The method of claim 16, wherein the step of forming a fluid injection bore in at least a portion of the platform structure comprises, in sequence, the steps of:

forming the fluid injection bore in the platform cover extending from a radially inner side of the platform cover to a radially outer side of the platform cover at a shallow angle of less than about 20 degrees relative to an outer side of the platform cover; and positioning the platform cover over the platform member with the radially inner side of the platform cover in engagement with a radially outwardly facing surface of the platform member.

* * * * *